US007971808B2

(12) United States Patent
Gerl et al.

(10) Patent No.: US 7,971,808 B2
(45) Date of Patent: Jul. 5, 2011

(54) METHOD FOR A CONTINUOUS DRY MILLING OPERATION OF A VERTICAL GRINDING MILL AND VERTICAL GRINDING MILL

(75) Inventors: Stefan Gerl, Werbach (DE); Jens Sachweh, Höpfingen (DE)

(73) Assignee: Maschinenfabrik Gustav Eirich GmbH & Co. KG, Hardheim (DE)

( * ) Notice: Subject to any disclaimer, the term of this patent is extended or adjusted under 35 U.S.C. 154(b) by 140 days.

(21) Appl. No.: 12/525,250

(22) PCT Filed: Jan. 4, 2008

(86) PCT No.: PCT/EP2008/000030

§ 371 (c)(1),
(2), (4) Date: Jul. 30, 2009

(87) PCT Pub. No.: WO2008/092542

PCT Pub. Date: Aug. 7, 2008

(65) Prior Publication Data

US 2010/0102151 A1 Apr. 29, 2010

(30) Foreign Application Priority Data

Feb. 2, 2007 (DE) ..... 10 2007 005 250

(51) Int. Cl.
*B02C 19/00* (2006.01)

(52) U.S. Cl. ..... 241/19; 241/57; 241/172

(58) Field of Classification Search ..... 241/19, 241/57, 171, 172
See application file for complete search history.

(56) References Cited

U.S. PATENT DOCUMENTS

| | | | | |
|---|---|---|---|---|
| 4,754,934 | A | | 7/1988 | Ikebuchi et al. |
| 5,158,240 | A | * | 10/1992 | Ihara et al. ..... 241/172 |
| 5,346,146 | A | * | 9/1994 | Nitta ..... 241/172 |
| 5,630,558 | A | | 5/1997 | Nitta et al. |

FOREIGN PATENT DOCUMENTS

| | | | |
|---|---|---|---|
| DE | 1242078 | B | 6/1967 |
| DE | 1507653 | A1 | 5/1971 |
| DE | 268892 | A1 | 6/1989 |
| DE | 4202101 | A1 | 7/1993 |
| JP | 2003181316 | A | 7/2003 |
| JP | 2005246204 | A | 9/2005 |

* cited by examiner

*Primary Examiner* — Faye Francis
(74) *Attorney, Agent, or Firm* — Browdy and Neimark, P.L.L.C.

(57) ABSTRACT

The invention relates to a vertical grinding mill including a closed vertical milling container in which a screw conveyor is arranged for rotary drive so as to convey grinding bodies to the top. The package of grinding bodies adjusts itself during operation such that the surface thereof is configured to slope radially outwards and downwards and to end in the region of the bottom edge of an outlet for grinding stock. Gas is introduced into the milling container above the package of grinding bodies. The gas and grinding stock are discharged from the milling container via the outlet for grinding stock.

6 Claims, 4 Drawing Sheets

METHOD FOR A CONTINUOUS DRY MILLING OPERATION OF A VERTICAL GRINDING MILL AND VERTICAL GRINDING MILL

BACKGROUND OF THE INVENTION

1. Field of the Invention

The invention relates to a method for a continuous dry milling operation of a vertical grinding mill which comprises

- a vertical, closed milling container,
- a screw conveyor which is arranged centrally in the milling container, the screw conveyor comprising
  - a drive shaft with a central axis and
  - at least one screw flight which is arranged on the drive shaft, extends along a height hs up to an upper end and covers the cross-section of the milling container only partially;
- a package of grinding bodies, the package having an upper surface;
- a grinding stock inlet which projects into the milling container above the package of grinding bodies,
- a gas inlet which projects into the milling container for introducing gas,
- a grinding stock outlet which projects out of the milling container and has a lower edge and a height h13 for discharging grinding stock and gas and
- a motor for driving the screw conveyor in a direction of rotation where the at least one screw flight conveys grinding bodies upwards.

The invention further prelates to a vertical grinding mill comprising

- a vertical, closed milling container,
- a screw conveyor which is arranged centrally in the milling container, the screw conveyor comprising
  - a drive shaft with a central axis and
  - at least one screw flight which is arranged on the drive shaft, extends along a height hs up to an upper end and covers the cross-section of the milling container only partially;
- a package of grinding bodies, the package having an upper surface;
- a grinding stock inlet which projects into the milling container above the package of grinding bodies,
- a gas inlet which projects into the milling container for introducing gas,
- a grinding stock outlet which projects out of the milling container and has a lower edge and a height h13 for discharging grinding stock and gas and
- a motor for driving the screw conveyor in a direction of rotation where the at least one screw flight conveys grinding bodies upwards.

2. Background Art

A vertical grinding mill of the generic type is known from U.S. Pat. No. 4,754,934. In this embodiment, the gas is introduced at the bottom of the milling container and flows through the package of grinding bodies and grinding stock. In the upper region of the milling container, well above the grinding stock inlet, a centrifuge is arranged on the drive shaft which causes grinding stock particles transported upwards by the gas flow to be flung away in such a way that they are immediately returned to the milling process due to the gravitational force. The gas needs to have a considerable amount of pressure, allowing the gas flow introduced into the package of grinding bodies from below to loosen up the package and to move the grinding stock particles upwards for them to be discharged at the upper end of the mill. When the package of grinding bodies and circulating grinding stock is loosened as mentioned above, the grinding effect, in other words the milling performance, is reduced. In order to keep the pressure loss in the package of grinding bodies and grinding stock within reasonable limits, the package needs to be relatively open porous, in other words there is a lower limit in terms of the size of the grinding bodies. Furthermore, the grinding stock needs to be relatively coarse. This in turn results in that the gaps between the individual grinding bodies are not sufficiently filled with grinding stock. Moreover, the energy consumption of the pressure blower is very high, the energy consumption being in the same order of magnitude as the energy consumption of the drive motor for the actual milling process.

A vertical grinding mill is known from DE 42 02 101 A1 where the grinding stock is fed into the milling container from above and discharged through a screen in the region of the bottom. In order to prevent the screen from becoming clogged or blocked, a fluid—for instance in the form of air—is introduced in the region of the bottom. A comparable vertical grinding mill is known from JP 2003 181 316 A1. The screen holes or screen slots located in the region of the bottom may become clogged by worn-out or broken grinding bodies. This in turn results in increased wear which may even cause damage to the lower ends of the screw flights. Another disadvantage is that free-flowing grinding stock such as dry silica sand flows through the package of grinding bodies at very high speeds and is therefore not subjected to a controlled milling process.

In order to avoid the aforementioned disadvantages, it is known from JP 2005 246 204 A to discharge the entire package of grinding bodies and the milled grinding stock from the milling container via a screw conveyor arranged in the bottom region. In this known embodiment, the mixture of grinding bodies and grinding stock needs to be separated outside the milling container, for instance by sieving. The grinding bodies need to be recirculated together with the new grinding stock. This requires a considerable amount of technical effort.

Furthermore, it is known from DD 268 892 A1 to blow the grinding stock out at the upper end of the vertical grinding mill by means of compressed air introduced in the bottom region or to discharge said grinding stock at the upper end of the open milling container via a circular, plane overflow edge. The disadvantage thereof is that no compact package of grinding bodies with a direct contact between grinding stock and grinding bodies is formed during operation as the grinding bodies float in the dry grinding stock. Furthermore, it may occur that grinding bodies are discharged via the overflow edge.

SUMMARY OF THE INVENTION

It is the object of the invention to provide a method of the generic type and a vertical grinding mill of the generic type which allow a continuous dry milling process to take place with the package of grinding bodies remaining in the milling container, and which allow the use of relatively small grinding bodies whilst ensuring a high fineness of the milled grinding stock.

In a method of the generic type, this object is achieved according to the invention in

- that the surface of the package of grinding bodies is adjusted in such a way when the screw conveyor is driven for rotation that it obtains an approximately frustoconical shape which slopes radially outwards and ends radially outside in the region of the lower edge of the grinding stock outlet, that the gas is introduced into the milling container above the package of grinding bodies, and that gas and grinding stock are discharged from the milling container in the region of the surface of the package of grinding bodies through the grinding stock outlet.

The grinding stock package is tight during the entire milling process as it is not loosened up from below by means of gas, for example. The grinding bodies are conveyed upwards in the region which is covered by at least one screw flight, and correspondingly flow downwards in the annular region which is not covered by the screw flight and which is delimited towards the outside by the milling container. The entire grinding stock is therefore conveyed through the grinding body package from the top to the bottom at least once and one more time from the bottom to the top, and is thus subjected to a milling process. The conveying effect of the screw flight in the region of the drive shaft causes the grinding body package to be lifted in the inner region of the milling container to such an extent that an approximately frustoconical surface is formed which slopes outwards, thus allowing the grinding bodies to roll towards the periphery. When this happens, they push the grinding stock located on or in the surface through the grinding stock outlet and out of the milling container; this is supported to a considerable extent by the gas flow.

The object of the invention is furthermore achieved by means of the vertical grinding mill wherein the grinding stock outlet comprises an outlet opening with a screen, the upper end of the at least one screw flight is arranged on a level with the screen, and the gas inlet is arranged above the upper end of the at least one screw flight according to claim 13.

Further features, advantages and details of the invention will become apparent from the ensuing description of embodiments by means of the drawing.

DESCRIPTION OF THE PREFERRED EMBODIMENT

Figure 1:
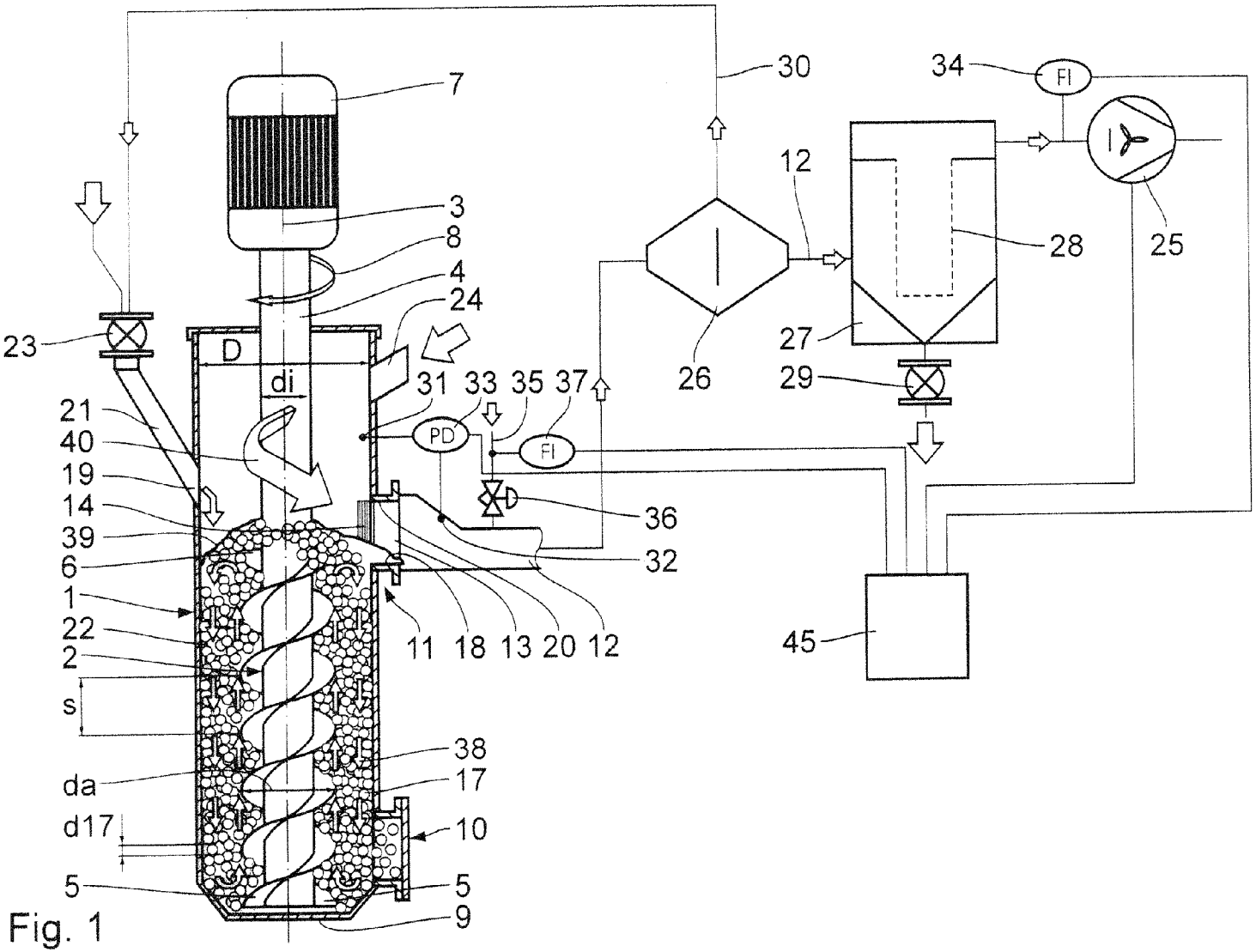
FIG. 1 is a diagrammatic illustration of a vertical grinding mill with a gas flow in a rotational flow.

The vertical grinding mill shown in the drawing comprises a cylindrical milling container 1 which is closed at the top, the internal diameter D thereof being such that $0.4\ m \leqq D \leqq 4.0\ m$. In the milling container 1 is arranged a screw conveyor 2 serving as a grinding body circulation unit, the screw conveyor 2 being arranged coaxially to the vertical central axis 3 of the milling container 1. The screw conveyor 2 comprises a drive shaft 4 with a diameter di which is arranged coaxially to the central axis 3, with two parallel screw flights 5 with a pitch s and an external diameter da and an upper end 6 being mounted on said drive shaft 4. The shaft 4 is drivable for rotation in a direction of rotation 8 by means of an electric motor 7. The screw conveyor 4 extends down into the immediate proximity of the bottom 9 of the milling container 1. From this proximity, the screw flights 5 extend towards the bottom 9 along a height hs. The vertical grinding mill is very slender. The ratio of the screw height hs to the diameter D of the milling container 1 is such that $1.5 \leqq hs/D \leqq 3$.

In the proximity of the bottom 9 of the milling container 1 is provided a grinding body outlet 10 which is closed during operation. On the milling container 1 is formed a grinding stock outlet 11 which is approximately on a level with the upper end 6 of the grinding webs 5 and is adjoined by a grinding stock discharge line 12.

Figure 4:
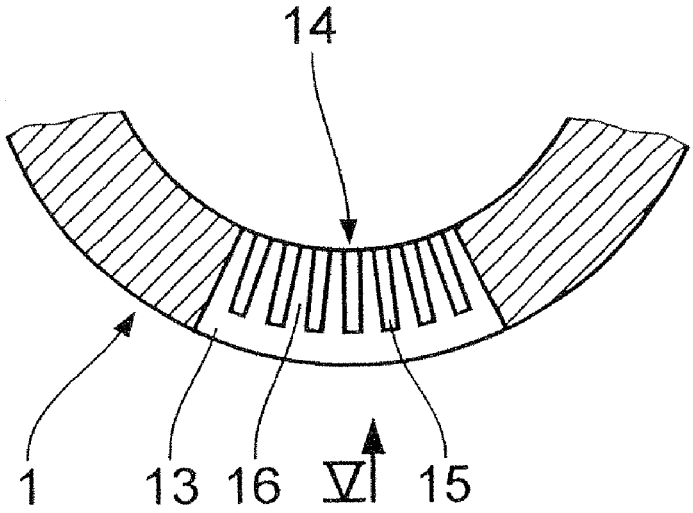
FIG. 4 is a partial horizontal section through a screen in the grinding stock outlet.
Figure 5:
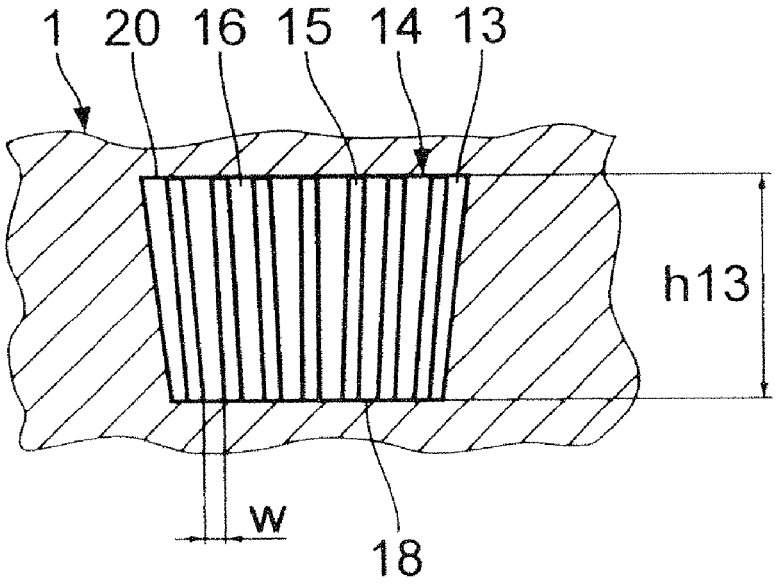
FIG. 5 is a plan view of the screen according to directional arrow V in FIG. 4.

A grinding body retaining device in the form of a slotted hole screen 14 is arranged in the outlet opening 13 of the grinding stock outlet 11 as shown in FIGS. 4 and 5. The slotted hole screen 14 comprises slotted holes 16 between webs 15 extending approximately parallel to the central axis 3, the width of the slotted holes 16 increasing radially outwards relative to the axis 3 as shown in FIG. 4 and furthermore from the bottom to the top as shown in FIG. 5. At least in the lower region, their width w is smaller than the diameter d17 of the smallest grinding bodies 17 used.

The outlet opening 13 has a height h13. The screw flights 5 extend along the lower edge 18 of the outlet opening 13 from 0.1 h13 to 0.5 h13, in other words their upper end 6 is located above the lower edge 18 in this region.

The cross-sectional area covered by the screw flights 5 is $(da^2-di^2)\times\pi/4$. The free annular cross-sectional area between the screw flights 5 and the milling container amounts to $(D^2-da^2)\times\pi/4$. The free cross-sectional area between the screw flights 5 and the milling container 1 shall be greater or at least equal to the annular cross-section covered by the screw flights 5, with $(D^2-da^2) \leqq (da^2-di^2)$.

In the embodiment according to FIG. 1, a grinding stock inlet 19 projects into the milling container 1 diametrically opposite to the grinding stock outlet 11. The grinding stock inlet 19 is arranged above the upper end 6 of the screw flights 5, starting approximately above the upper edge 20 of the outlet opening 13. A grinding stock feed line 21 is arranged upstream of the grinding stock inlet 19, with grinding stock 22 being supplied to said feed line 21 via a gas-tight dosing device 23 such as a rotary gate valve.

Above the outlet opening 13, i.e. also above the grinding stock inlet 19, a gas inlet 24 which is open to the atmosphere, i.e. an air inlet in this particular case, is provided on the side of the outlet opening 13.

The grinding stock discharge line 12 is connected to a suction blower 25, with a pneumatic separator 26 such as a conventional cyclone separator as well as a dust filter separator 27 arranged downstream thereof being connected therebetween. In the separator 27 is provided a filter 28. The filter 28 is connected from below to a gas-tight gate valve 29 such as a rotary gate valve. Coarse grinding stock from the pneumatic separator 26 is recirculated to the dosing device 23 and therefore to the grinding stock inlet 19 via a return line 30. The grinding stock discharged from the separator 27 has the desired fineness.

In the milling container 1 is arranged a pressure transducer 31. Likewise, another pressure transducer 32 is arranged in the grinding stock discharge line 12 relatively close behind the grinding stock outlet 11. The pressure values delivered by said pressure transducers 31, 32 are transmitted to a differential pressure measuring device 33 in order to detect the pressure difference between the two measured values. In the line 12, a gas volume measuring device 34 is arranged between the separator 27 and the blower 25. Furthermore, an additional gas line 35 projects into the grinding stock discharge line 12 near the grinding stock outlet 11, the additional gas line 35 being openable or closable by means of a controllable valve 36. The additional gas line 35 allows additional gas to be introduced into the line 12 if the gas flow from the milling container 1 is not sufficient in order to discharge the grinding stock. This line 35 is provided with a gas volume flow measuring device 37 as well.

The mode of operation is as follows:

Prior to start-up, the milling container 1 is filled with grinding bodies 17 up to a level which amounts to 80% to 95% of the height of the milling container 1 up to the upper end 6 of the screw flights 5 to just above the lower edge 18 of the outlet opening 13. Afterwards the motor 7 is started, causing the shaft 4 with the screw flights 5 to be rotated in the direction of rotation 8. Corresponding to the pitch of the screw flights 5, the grinding bodies 17 located in the annular cross-sectional region of the grinding body 1 covered by the screw flights 5 are conveyed upwards. In order to achieve a reliable conveying effect, the ratio of the pitch s of the screw flights 5 to the external diameter s of the screw webs 5 is such that $0.5\ da \leqq s \leqq 1.5\ da$ and preferably $0.8\ da \leqq s \leqq 1.2\ da$. Furthermore, the shaft 4 with the screw flights 5 is driven at such a speed that the screw flights 5 have an outer peripheral speed of 2.0 to 4.0 m/scc and preferably between 2.2 and 3.0 m/sec. The diameter d17 of the grinding bodies 17 is such that $10\ mm \leqq d17 \leqq 30\ mm$ and preferably $15\ mm \leqq d17 \leqq 25\ mm$.

When the screw conveyor 2 starts to rotate, grinding stock to be milled is fed into the milling container 1 via the gas-tight dosing device 23. The supplied grinding stock 22 generally has a grain size which is smaller than 0.25 d17 of the diameter d17 of the grinding bodies 17 and preferably smaller than 0.2 d17. As the grinding bodies 17 are conveyed upwards in the region of the screw flights 5, they move downwards in the outer region which is not covered by the screw flights 5, as indicated by the circulating flow arrows 38 in FIG. 1. The grinding stock supplied in the region of the container wall flows down together with the grinding bodies 17 and is crushed between them. The grinding stock is then conveyed upwards again in the region of the screw flights 5 together with the grinding bodies 17 and is thus subjected to further milling. As can be seen from the drawing as well, the grinding bodies 17 in the region of the screw flights 5, in other words immediately next to the shaft 4, are lifted above the ends 6 of the screw flights 5 to such an extent that the package of grinding bodies 17 and grinding stock 22 obtains an approximately frustoconical surface 39. The grinding bodies 17 are located only slightly, namely up to 0.3 h13, above the lower edge 18 of the outlet opening 13 or of the screen 14, respectively. Grinding stock 22 on the other hand which flows radially out of the package of grinding bodies 17 is located directly in front of the screen 14.

During this milling process, air is sucked in from the outside through the gas inlet 24 by means of the blower 25 and flows around the shaft 4 and across the surface 39 of the grinding stock package in the direction of the deflection arrow 40. If the gas inlet 24 is substantially orthogonal, in other words if it is directed substantially towards the axis 3, the air is only deflected through 180° about the shaft 4. If, on the other hand, the gas inlet 24 is substantially tangential, this results in a rotational flow. Air which is transported through the milling container 1 in the direction of the deflection arrow 40 entrains particularly fine grinding stock 22, which is supplied via the grinding stock inlet 19, directly and discharges said grinding stock 22 directly as well. The gas flow enters the grinding stock discharge line 12 through the screen 14. When this happens, the described gas flow presses the grinding stock 22 located in the milling container 1 in front of the screen 14 into the line 12. If grinding bodies 17 reach the region in front of the screen 14, they are retained by the screen 14. The entire grinding stock 22 is generally discharged after one described circulation. In the pneumatic separator 26, the coarse grinding stock 22 which has not yet been milled sufficiently is separated and recirculated to the milling process via the return line 30 and via the dosing device 23. The carrier air enters the dust filter separator 27 together with the finely milled grinding stock 22 where the finely milled grinding stock is separated by the filter 28 and discharged via the gate valve 29. The air, which is now free from grinding stock 22, is exhausted via the blower 25.

If the air which is introduced into the milling container 1 and exhausted via the grinding stock outlet 11 is not sufficient for the described discharge process to be performed, an additional amount of air can be supplied to the carrier air via the additional gas line 35.

Figure 2:
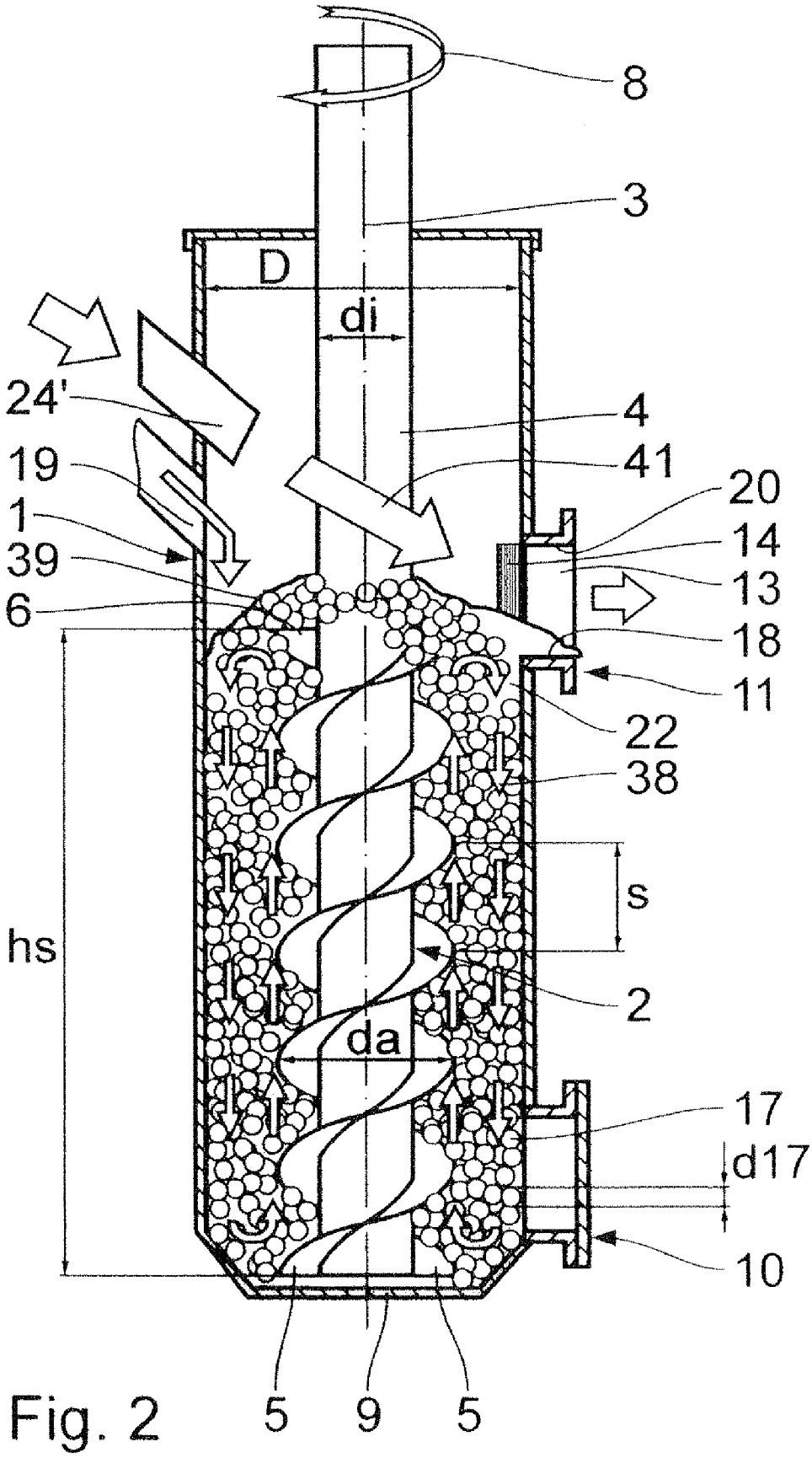
FIG. 2 shows a modified embodiment of the milling container of a vertical grinding mill according to FIG. 1, with a gas flow being introduced diametrically relative to the grinding stock outlet.

The layout of the actual vertical grinding mill according to FIG. 2 differs from that according to FIG. 1 by the arrangement of the gas inlet 24'. Said gas inlet 24' is located opposite the grinding stock outlet 11 above the grinding stock inlet 19. In this embodiment, the air flow flows around the shaft 4 in the direction of the flow arrow 41 and then—as in the embodiment according to FIG. 1—across the surface 39 of the package of grinding stock and grinding bodies so as to press the milled grinding stock 22 through the screen 14 and into the grinding stock discharge line 12. In order to prevent the air flow from conveying the grinding stock 22 entering through the grinding stock inlet 19 directly to the screen 14, the gas inlet 24' is displaced into the milling container 1 in the direction of the shaft 4, allowing the grinding stock 22 entering through the grinding stock inlet 19 to flow down into the grinding stock package directly along the inner wall of the milling container 1.

Figure 3:
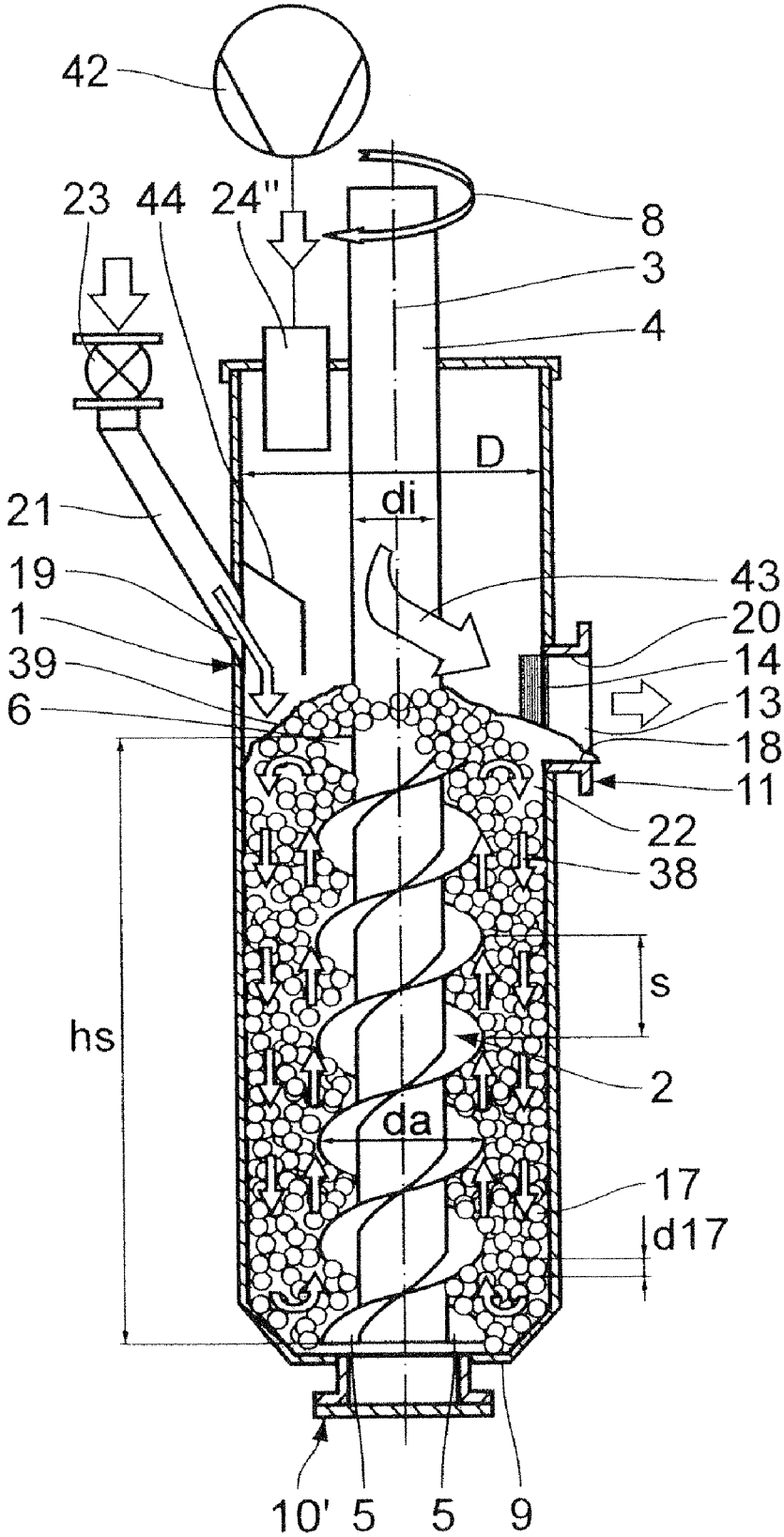
FIG. 3 shows a third embodiment of a milling container of a vertical grinding mill, with a gas flow being introduced vertically.

The embodiment according to FIG. 3 differs from the two embodiments described above in that the gas flow is not sucked in by means of a suction blower. In this embodiment, a pressure blower 42 is provided which presses gas at a randomly selectable pressure into the milling container 1 from above through a gas inlet 24". The gas flows through the milling container 1 from above in the direction of the flow arrow 43 and then across the surface 39 to the grinding stock outlet 11 and presses the grinding stock 22 through the screen 14 in the manner described above.

While in the embodiments according to FIGS. 1 and 2 a total delivery pressure of less than 1 bar is achievable due to the use of a suction blower 25, a generally random pressure is selectable when using a pressure blower 42. In order to prevent the gas flowing into the milling container 1 according to FIG. 3 in the direction of the flow arrow 43 from entraining the grinding stock 22 entering through the grinding stock inlet 19 or mixing said grinding stock 22 above the grinding body package, the grinding stock inlet 19 is covered by means of a baffle plate 44 in such a way that the entrance of grinding stock is not impaired by the gas flow. A baffle plate 44 of this type is of course optionally applicable in the embodiments according to FIGS. 1 and 2 as well for covering the grinding stock inlet 19.

In this embodiment, the grinding body outlet 10' is provided in the bottom 9 of the milling container 1, which may facilitate the removal of the grinding bodies 17 from the milling container 1.

The entire process can be fine-tuned by means of the differential pressure measuring device 33 and alternatively or cumulatively by means of the gas volume measuring device 34, 37.

In the simplest case, a measurement of the differential pressure is only performed by means of the measuring device 33 and the corresponding measuring value is transmitted to a central control device 45. If the measured differential pressure exceeds a predetermined desired value, this may indicate that the screen 14 is partially or completely clogged. In this case, the control unit 45 may actuate the blower 25 or the blower 42 to increase the main gas volume flow introduced via the gas inlet 24, 24' or 24" and/or to reduce the secondary gas volume flow introduced via the valve 36. The aim of this is to suck or press more gas through the screen 14.

When the two flow measuring devices 34, 37 are used, a main gas volume flow to be transported by the blower 25 or 42 is adjusted via the measuring device 34 for a particular predetermined mode of operation. The secondary gas volume flow introduced via the additional gas line 35 is adjusted in such a way that a predetermined desired gas volume flow is transported through the milling container 1. This desired gas volume flow transported through the milling container 1 is obtained from the difference of the main gas volume flow and the secondary gas volume flow. If the gas volume flows are continuously measured by the measuring devices 34 and 37, an increase of the flow detected by the measuring device 37 indicates that the screen 14 is partially or completely clogged. In such a case, the total gas volume flow to be transported by the blower 25 or 42 is increased. At the same time, the valve 36 is partially or completely closed so as to achieve a higher gas volume flow through the milling container 1 in order to clean the screen 14. The above described differential pressure measurement is cumulatively applicable as well.

What is claimed is:

1. A vertical grinding mill comprising a vertical, closed milling container (1);

a screw conveyor (2) which is arranged centrally in the milling container (1), the screw conveyor (2) comprising a drive shaft (4) with a central axis (3) and at least one screw flight (5) which is arranged on the drive shaft (4), extends along a height (hs) up to an upper end (6) and covers the cross-section of the milling container (1) only partially;

a package of grinding bodies (17), the package having an upper surface (39);

a grinding stock inlet (19) which projects into the milling container (1) above the package of grinding bodies (17);

a gas inlet (24, 24', 24") which projects into the milling container (1) for introducing gas;

a grinding stock outlet (11) which projects out of the milling container (1) and has a lower edge (18) and a height (h13) for discharging grinding stock (22) and gas; and a motor (7) for driving the screw conveyor (2) in a direction of rotation (8) where the at least one screw flight (5) conveys grinding bodies (17) upwards, wherein the grinding stock outlet (11) comprises an outlet opening (13) with a screen (14);

the upper end (6) of the at least one screw flight (5) is arranged on a level with the screen (14); and the gas inlet (24, 24', 24") is arranged above the upper end (6) of the at least one screw flight (5).

2. A vertical grinding mill according to claim 1, wherein the gas inlet (24) is arranged above the grinding stock outlet (11).

3. A vertical grinding mill according to claim 1, wherein the gas inlet (24') is arranged opposite the grinding stock outlet (11) and above the grinding stock inlet (19).

4. A vertical grinding mill according to claim 1, wherein the gas inlet (24") projects into the milling container (1) from above.

5. A vertical grinding mill according to claim 1, wherein a gas baffle plate (44) is provided in front of the grinding stock inlet (19).

6. A vertical grinding mill according to claim 1, wherein the screen (14) is a slotted-hole screen.

* * * * *